United States Patent [19]

Patel

[11] 4,420,041

[45] Dec. 13, 1983

[54] METHOD OF USING A VALVE IN GRAVEL PACKING

[75] Inventor: Dhirajlal C. Patel, Carrollton, Tex.

[73] Assignee: Otis Engineering Corporation, Dallas, Tex.

[21] Appl. No.: 439,862

[22] Filed: Nov. 8, 1982

Related U.S. Application Data

[62] Division of Ser. No. 232,710, Feb. 9, 1981, Pat. No. 4,378,842.

[51] Int. Cl.[3] ..... E21B 37/08

[52] U.S. Cl. ..... 166/278; 166/188; 166/133

[58] Field of Search ..... 166/278, 51, 317, 323, 166/276, 188, 133

[56] References Cited

U.S. PATENT DOCUMENTS

| | | | |
|---|---|---|---|
| 3,126,963 | 3/1964 | Graham | 166/51 |
| 3,627,046 | 12/1971 | Miller et al. | 166/278 |
| 3,749,119 | 7/1973 | Tausch et al. | 166/323 X |
| 3,826,309 | 7/1974 | Tausch | 166/323 X |

*Primary Examiner*—Ernest R. Purser
*Assistant Examiner*—Thuy M. Bui
*Attorney, Agent, or Firm*—Vinson & Elkins

[57] ABSTRACT

A method for protecting a well formation during gravel packing in which a back pressure valve is held off of its seat while gravel is being placed in the well, is automatically closed as the wash pipe is removed from the screen and in which the valve is returned to open position by a force exerted from above, either hydraulic or mechanical.

A valve is held open by a prop-out which is removable to permit the valve to swing to closed position and thereafter the valve is again opened in response to mechanical or hydraulic force from above.

6 Claims, 9 Drawing Figures

METHOD OF USING A VALVE IN GRAVEL PACKING

This application is a division of pending application Ser. No. 06/232,710 filed Feb. 9, 1981 now Pat. No. 4,378,842.

This invention relates to method and apparatus for use with gravel pack operations.

It is conventional to pack wells with gravel between the well casing and production screen in many instances. A discussion of techniques and an illustration of equipment used in gravel packing will be found in Composite Catalog of Oil Field Equipment and Services, 31st Revision, 1974–75, at pages 3936 and 3937.

In some instances it is highly desirable to control the effect of pressure fluids in the well bore on the producing formation during the gravel pack procedure.

For instance, where gravel has been packed between the casing and liner and it is desired to prevent well fluid from being effective on the formation prior to beginning production of a well it has been customary to spot a gel material in the bore through the liner as the wash pipe is withdrawn to close the liner to fluid flow and protect the formation from fluids in the well above the liner while the handling string is being pulled from the well and a production string is thereafter inserted. Several days may be involved in the operations of cleaning up the well bore and round-tripping the handling string and production string and during this time the gel has been utilized in the liner bore to prevent well bore fluids from reaching the well formation through the liner.

BRIEF SUMMARY OF THE INVENTION

It is an object of this invention to provide apparatus and method of operating apparatus to close the liner bore to fluids within the well thereabove to protect the formation from the effects of such fluid during completion of a well.

Another object is to provide a method of protecting a well during gravel pack operations in which a valve controlling flow into the well screen is held open during packing of gravel, is maintained closed after the wash pipe is pulled from the screen and during round-tripping of the handling string and production string and is opened in response to a downward force, preferably after the production string has been lowered into the packer.

Another object is to provide a method as in the preceding object in which the valve may be opened in response to either hydraulic pressure or mechanical movement, as by downward movement of the production string.

Another object is to provide a method of protecting a formation during gravel pack operations in which a valve controlling flow into the well screen is initially mechanically propped-out of service to permit gravel to be placed in the casing and the prop-out releases the valve and permits it to close in response to withdrawal of the wash pipe.

Another object is to provide a method and apparatus for protecting a formation during gravel packing in which a valve controls flow into the liner and wherein the production string when landed maintains the valve in open position.

Another object is to provide a valve which may be propped in the open position, will then automatically close in response to removal of the prop-out, and which may be re-opened in response to a mechanical force or to hydraulic pressure exerted from the high pressure side of the valve.

Another object is to provide apparatus for protecting a well during gravel packing in which a valve controlling flow through the screen is propped-open and a seal is provided between the valve and wash pipe to protect the formation as the wash pipe is withdrawn and the valve closed.

Other objects, features and advantages of the invention will be apparent from the drawings, the specification and the claims.

BRIEF DESCRIPTION OF THE SEVERAL VIEWS OF THE DRAWINGS

In the drawings, wherein an illustrative embodiment of this invention is shown and wherein like reference numerals indicate like parts.

DETAILED DESCRIPTION

Figure 1:
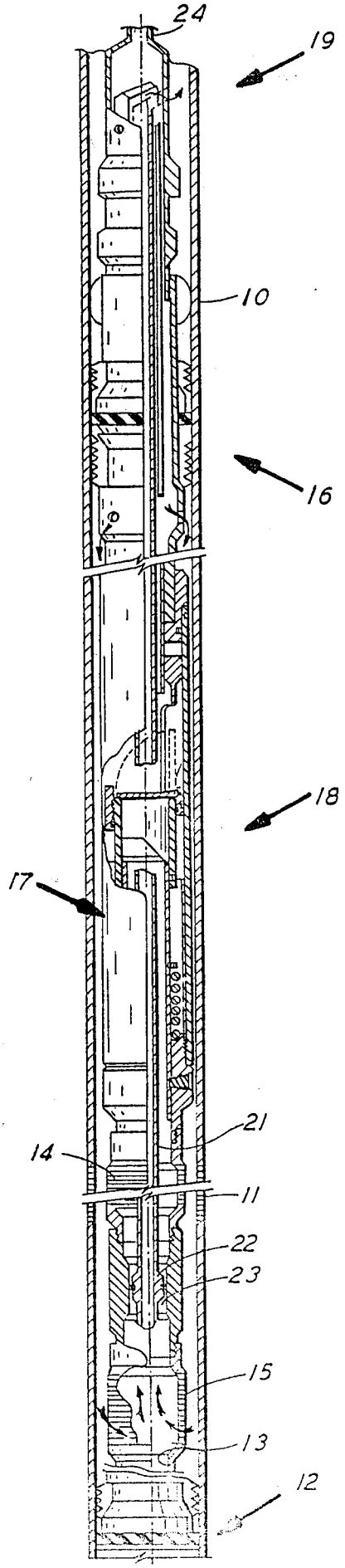
FIG. 1 is a schematic illustration of a gravel pack system including a protective valve shown partially in elevation and partially in quarter-section.

In carrying out the method of the invention, the well assembly used in gravel packing will include a valve controlling flow through the system above the well screen. As shown in the drawings, this valve may be a flapper type back-check valve. It may also readily be a ball-type valve, or any other type of valve which may be easily propped-open by a prop-out such as a sleeve or the common wash pipe used in gravel pack operations. It is only necessary to protect the formation from fluid within the screen as the gravel pack above the screen will adequately protect the formation from the fluids in the well above the gravel pack.

The well assembly is run in and landed in the well with one or more packers in the conventional manner with the wash pipe in place in the well screen as is conventional. The protecting valve is propped-open at this time, either by the wash pipe or by a prop-out sleeve, or other desirable means so that normal gravel packing and other operations, as desired, can be carried out with the wash pipe in place in the well screen.

After all desired operations are completed with the wash pipe in place, the wash pipe is raised in the customary manner. At this time it is desirable in many instances to protect the formation against well fluids in the well above the packer. In accordance with this invention as the wash pipe is removed the valve is closed to isolate the bore through the well screen from the fluids in the well above the screen. This is preferably done by either the wash pipe functioning as a prop-out which releases the valve and permits it to close as the wash pipe clears the valve, or by having a boss or enlargement on the wash pipe engage a downwardly facing shoulder on a prop-out sleeve so that as the wash pipe is removed it will engage the prop-out sleeve and pull the prop out sleeve up to a non-functional position in which the valve may close. Preferably, the prop-out sleeve remains on and is retrieved from the well with the wash pipe, but it will be apparent that the sleeve might be moved to a non-functional position and then be disengaged by the wash pipe, if desired.

With the valve thus protecting the formation, the desired operations may be carried out with the wash pipe disengaged, such as cleaning up the well bore. The handling string is then retrieved from the well and a production tubing run into the well in its place. It will be appreciated that these operations may take several days, during which the formation is protected by the closed valve.

When the production string reaches the assembly on bottom it conventionally seals with the upper packer to provide for a fluid tight conduit between the formation and the surface. Preferably, after the seals are engaged the tubing may be pressured up to render the protecting valve ineffective. This may be done by constructing the valve such that the valve member will be ruptured or destroyed, such as utilizing a frangible valve member of glass or of metal which will rupture under the opening pressure to provide a full open bore through the equipment. Alternatively and preferably, the structure is such that the valve member is automatically moved to open position as by shearing a pin in response to pressure as shown in the preferred apparatus and moving the valve member and valve opener into engagement with each other to positively move the valve to open position.

Alternatively, instead of employing pressure to open the valve the production string may have a depending tail pipe which effects destruction or opening of the valve member. Such a depending tail pipe could readily shatter a glass flapper valve or rupture a metal valve member designed to rupture under pressure or from a downward force exerted by a tail pipe. In the preferred form as shown in the drawings, the tail pipe engages an actuator and the actuator forces the valve assembly to move into a position in which a valve opener engages the valve member and moves it to its open position. Preferably, when this type of operation is carried out the tail pipe on the production string also will positively maintain the assembly in the valve-open position.

Referring first to FIG. 1, a casing 10 is provided in a well formation for production through the casing perforations 11.

If desired, a lower packer indicated generally at 12 may be provided in the hole below the producing formation. Stabbed into the lower packer 12 is the screen tail pipe 13 which seals with the packer in the conventional manner. The screen includes the conventional production screen 14 and, if desired, an optional telltale screen 15.

An upper packer indicated generally at 16 is landed in the casing and the upper packer is secured to the screen 14 by a short pipe section indicated generally at 17 which includes a valve indicated generally at 18. This valve is shown schematically in FIG. 1 and in detail in other Figures in the drawings.

At the upper end of the assembly a conventional crossover is indicated generally at 19 and there depends from this crossover and extends down past the screen a wash pipe 21 which has an enlarged boss 22 which in the conventional manner seals with the polished nipple 23 during the gravel pack operations.

After gravel has been suitably packed between the casing 10 and the screen 14, the work string 24 is lifted in the conventional manner to position it in non-sealing engagement with the remainder of the assembly to continue the normal completion procedures. At this time the wash pipe is lifted to release the back pressure valve indicated generally at 18 to permit it to close and protect the well formation against fluids in the well thereabove. The gravel pack between the casing and screen will protect the formation against fluids flowing down through this annulus and the valve 18 will protect the formation against fluids flowing downwardly through the blank pipe 17 and into the bore through the screen 14.

After the work string 24 is removed a conventional production string is landed in the upper packer 16 in the conventional manner and the valve 18 is rendered ineffective, preferably either by pressure or manipulation of the production string as will appear more fully hereinafter.

Figure 2A:
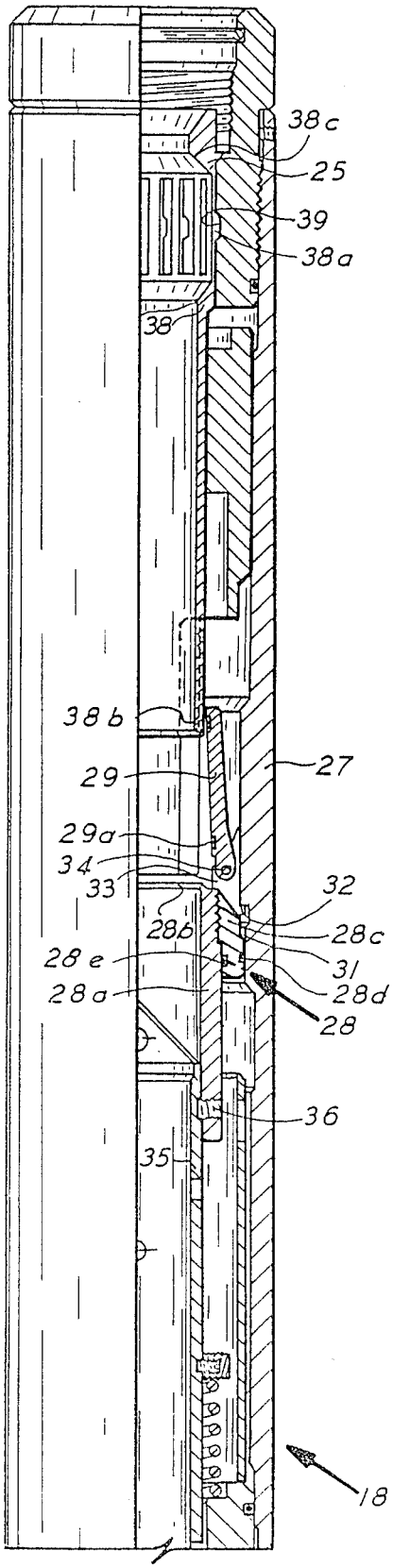
FIGS. 2A and 2B are continuation views partially in elevation and partially in quarter-section illustrating a valve constructed in accordance with this invention.
Figure 2B:
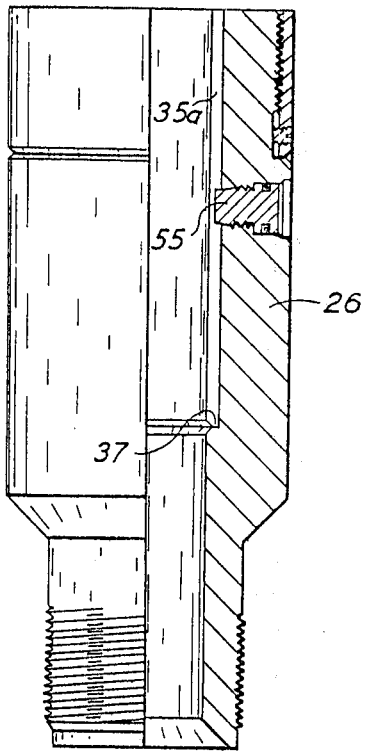

Reference is now made particularly to FIGS. 2A and 2B in which the valve indicated generally at 18 is illustrated in detail. The valve 18 has a body including an upper sub 25 and a lower sub 26 interconnected by an intermediate body section 27.

The body has a bore therethrough which varies in diameter to provide various shoulders, lands and grooves as will appear hereinbelow in the description of other portions of the valve.

A valve seat indicated generally at 28 is provided in the bore and cooperates with the valve member 29 which in the illustrated form is a check valve of the flapper type to control flow through the valve. As will be obvious to those skilled in the art, a ball valve could be substituted for the flapper valve and rotated about an offset eccentric as is the flapper 29 to provide a back-check valve. Both of these forms of valves provide a full open passageway when open and are preferred.

The body is designed to accommodate the valve seat 28 in two different positions. The first position is that shown in FIG. 2A and the second position is that shown in FIG. 5.

The valve seat 28 may take any desired form. In the illustrated and preferred embodiment the entire valve seat assembly is shown generally at 28 and includes a tubular extension **28*a* which has at its upper end a valve seat surface 28*b* for sealing with the elastomeric seal 29*a* on the valve member 29. Secured to and surrounding the tubular extension 28 is a seal carrier 28*c* which carries the sliding seal 28*d* and the stationary seal 28*e* between the parts 28*a* and 28*c***.

To seal with the seat 28 the intermediate body section 27 is provided with a land 31 and a stop shoulder 32. The land 31 receives the sliding seal **28*d* and seals between the seat and body. The shoulder 32 is engaged by the standard 33 which extends upwardly from seat section 28*c* and carries the pin 34 on which the valve 29** is mounted for swinging movement.

The valve seat 28 is held in its upward position in engagement with the shoulder 32 by a tubular valve opening member 35 which is telescoped within the valve seat 28 and is secured thereto by a shear pin 36. The tubular member 35 abuts an upwardly facing shoulder 37 in the lower sub 26 and thus the valve seat is held in upper position as shown in FIG. 2A.

Positioned within the upper sub 25 is a prop-out 38 which is sleeve-like in form and is provided with collet fingers 38*a* at its upper end which engage within the groove 39 in the upper sub 25 to hold the prop-out in the position illustrated in FIG. 2A. In this position the prop-out is dimensioned so that its lower end 38*b* will engage the upper end of valve member 29 and maintain it in full open position.

The several parts of the valve 18 are held in the position shown in FIGS. 2A and 2B and the wash pipe 21 extends entirely through the valve when the assembly is run into the well. As noted hereinabove, the prop-out 38 may be omitted and the wash pipe 21 will serve as the prop-out maintaining the valve 29 in its full open position.

Figure 3:
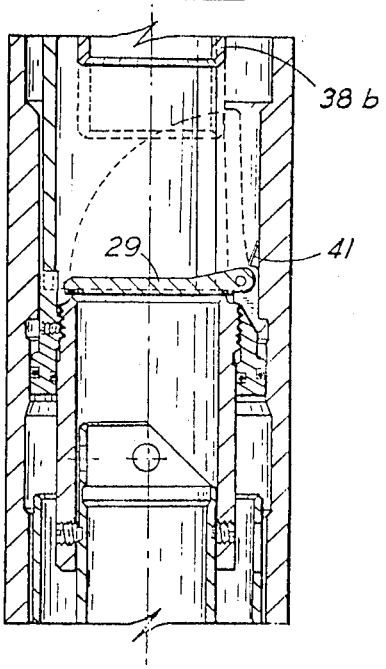
FIG. 3 is a fragmentary view in cross-section similar to FIG. 2 showing the valve in closed position.

Reference is now made to FIG. 3 as well as FIGS. 2A and 2B to illustrate the condition of the valve when the wash pipe is moved upwardly in the well. Where the prop-out 38 is employed the boss 24 or other suitable structure on the wash pipe will engage the downwardly facing no-go shoulder 38*b* on the prop-out 38. As the wash pipe continues upwardly in the well it will carry the prop-out 38 with it and withdraw the lower end 38*b* of the prop-out from its position contacting the flapper valve 29 to an out of the way position shown in FIG. 3. At this time the spring 41 provides a resilient means which urges the valve member 29 to its full closed position as shown in FIG. 3.

At this time the screen below the valve is isolated from well pressures above the valve and will be protected therefrom during the remainder of the procedure until the valve is opened.

Reference is now made in particular to FIGS. 4A, 4B, 4C and 5 wherein opening of the valve and positively propping it in its open position is illustrated.

The production string 42 is run into the well and is sealed with the lower packer extension 43 by a suitable seal such as indicated generally at 44. At this time the operator has two options with the preferred form of structure for opening the valve; that is, hydraulic or mechanical.

The valve assembly is provided with a releasable means which when released results in the check valve being positively moved to its unseated or open position. By unseated position is included the concept of using a frangible valve member which may be in part or completely destroyed to effect a movement of the valve to its unseated position. Preferably, the releasable means is one which permits relative movement between the valve member 29 and a valve opening structure which will positively move the valve 19 to its open or unseated position. This action, of course, is in response to a force exerted downwardly, either mechanically or hydraulically as noted above.

Figure 5:
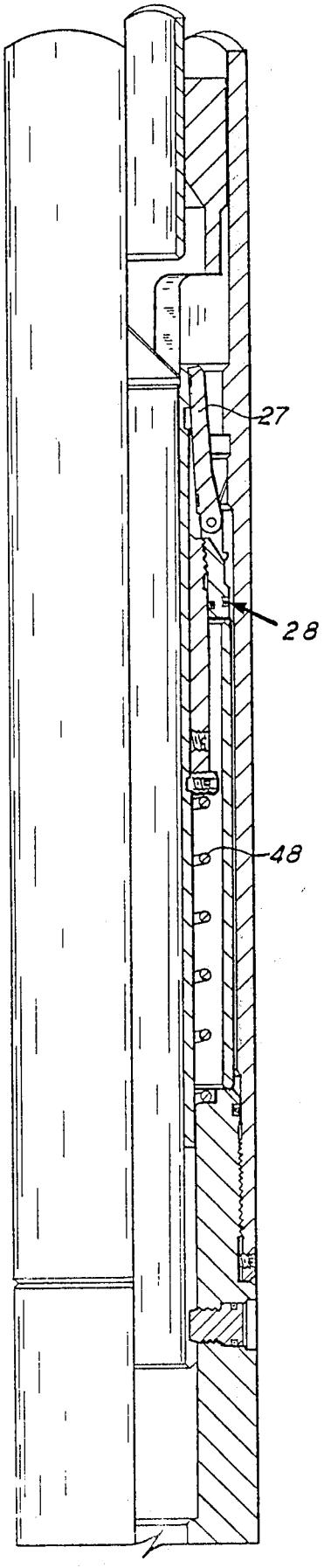
FIG. 5 is a fragmentary view similar to FIGS. 4A, 4B and 4C illustrating the valve opener to have been moved downwardly by the production string and to have opened the valve member.

In the preferred form the valve seat extension 28*a* is pinned to the valve opener 35 by the shear pin 36 as noted hereinabove. When suitable force is exerted downwardly against the valve seat indicated generally at 28 and the valve member 29, this force results in shearing of pin 36 to permit the entire valve seat and valve member to move downwardly in the valve body. This movement results in the seal 28*d* being uncovered as it moves into the groove 45 in the body to relieve the pressure differential across the valve member and seat. As shown in FIG. 5 the valve member and seat moves down to a position at which it engages and rests upon spacer 46 within the bore of the body.

It will be noted that the valve opener 35 does not sealingly engage the lower sub 26 and additionally ports 47 may be provided in the opener to insure that pressure can quickly equalize across the valve member and valve seat and permit the valve member 29 to move to its open position.

Preferably, a resilient means is provided to move the valve member 29 and the valve opener 35 relative to each other to insure that the valve opener 35 engages the valve member and moves it to open position.

Such a resilient means is provided by the spring 48 which is trapped between an upwardly facing shoulder 49 on the lower sub 26 and a spring stop 51 carried by the valve opener 35. Thus, as the shear pin 36 is sheared not only are the valve and seat urged downwardly by the differential pressure, but the valve opener 35 is urged upwardly by the spring 48. It results that after the pressure differential has been removed the parts will assume the position shown in FIG. 5 in which the spring 48 is fully extended and props the valve member 29 in its full open position. It should be noted that the upper end of the valve opener 35 preferably extends above the position of the valve 29 when in closed position. Thus, no matter what the position of the valve 29 and its supporting seat 28 after the shear pin 36 has sheared the valve opener moves up to a position in which it positively moves the valve member 29 to open position.

As an alternative, the valve 29 may be opened mechanically by the production tubing 42. For this purpose the tubing 42 has a tail pipe 42*a* thereon which has a downwardly facing shoulder 42*b* which engages a mechanical opening sleeve 52 in the intermediate body section 27. This sleeve has an upwardly facing shoulder 52*a* which engages the downwardly facing shoulder 42*b* on the production tubing and moves downwardly with the production tubing as shown in FIG. 5.

Where the mechanical opening sleeve 52 is employed it has a window 52*b* therein which is dimensioned to permit the valve 29 to swing in the window between open and closed positions. The sleeve 52 on its lower end and the seat member 28*c* on its upper end have a confronting and interengaging lug and slot relationship as shown generally at 54. In the preferred form the seat section 28*c* has an upwardly facing lug and the sleeve 52 has a downwardly facing slot as shown in dashing lines at 52*a* so that the valve seat 28 and the mechanical opening sleeve 52 are maintained in proper orientation to permit the valve member 29 to swing through the window provided at 52*b*.

The system is further oriented by having the lower end of the valve opener 35 provided with a slot 35*a* which receives a pin 55 carried in the lower sub 26 so that the entire system is held against rotation if it becomes necessary to mill through the valve. It will be noted from FIG. 4B and FIG. 3 that the lower end of the opening sleeve 52 engages the valve seat 28 at a point radially outward from the valve member 29 when the member is closed. Thus, downward movement of the production string 42 moves the mechanical opening sleeve 52 into engagement with the valve seat and a downward force may be exerted by the production string on the valve seat to shear pin 36. After the pin shears the production string 42 may be continued in its downward movement until the valve seat 28 bottoms out on the spacer sleeve 46 as shown in FIG. 5 and the mechanical opening sleeve will positively hold the valve seat 28 and its accompanying valve member 29 in down position in which the valve opener 35 will positively hold the valve member in full open position, thus providing a full open bore through the valve 28.

Figure 6:
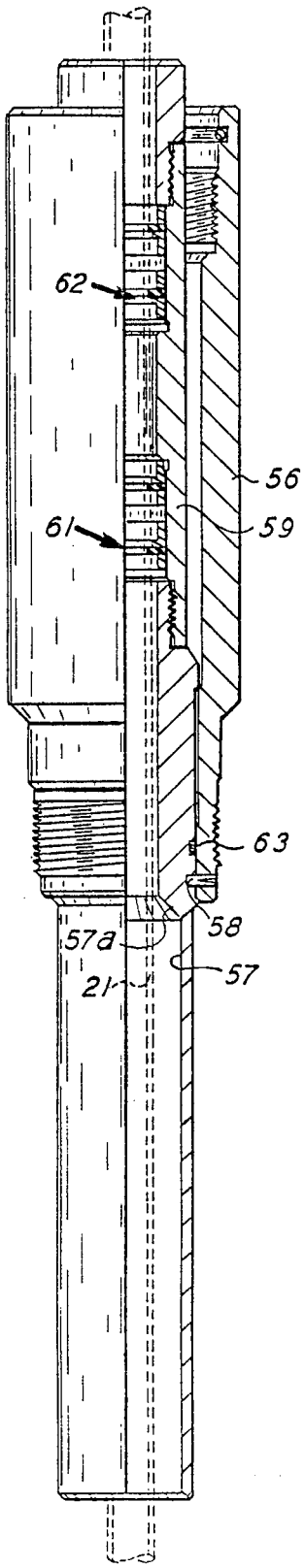
FIG. 6 is a view partially in elevation and partially in quarter-section illustrating a modified form of prop-open system which maintains a seal between the wash pipe and the prop-open sleeve until the wash pipe is above the valve.

In some instances it is desirable to further protect the liner bore from pressures in the well above the upper packer; that is, to protect the liner bore and the formation during the time the wash pipe is moving upwardly to engage the prop-out 38. In such instances the assembly shown in FIG. 6 may be threaded into the upper sub 25 so that its prop-out 57 substitutes for prop-out 38.

The thread on the upper end of upper sub 56 is identical to that on the upper end of sub 25. This sub 56 carries within its bore the prop-out 57 which is dimensioned and operates in the same manner as prop-out 38. The prop-out 57 is releasably secured to the upper sub by any suitable means, such as the shear pin 58.

In order to seal between the prop-out 57 and the wash pipe 21 the prop-out 57 carries on its upper end a seal section including a sleeve 59 having a plurality of seals at 61 and 62. These seals provide a sliding seal with the wash pipe and protect the bore through the liner against fluid above the packer as the wash pipe is drawn upwardly out of the liner.

As the wash pipe enlargement 22 engages the downwardly facing shoulder 57*a* on the prop-out 57 it will raise the prop-out and the seal section with the wash pipe by shearing the pin 58. A sliding seal 63 is provided between the upper sub 56 and the prop-out 57. As this seal moves up through the bore of the upper sub 56 very little, if any, fluid will be permitted to pass the seal until after the prop-out has released the valve and permitted it to close. While the bore through the upper sub 56 is slightly enlarged above the seal to minimize alignment problems very little fluid will pass the seal as the prop-out is raised. If desired, of course, the bore of the upper sub 56 engaged by this O-ring might be of a sufficient length to prevent any fluid flowing thereby until after the valve member is released.

In operation of the system the screen, packers, valve 18 and wash pipe 21 are made up as a unit, as shown in FIG. 1, and run into the well on the work string 24. At this time either the wash pipe or one of the prop-outs 38 or 57 will be maintaining the valve member 29 in open position.

After gravel has been introduced and other desired operations carried out the work string is lifted to move the wash pipe upwardly through the screen into engagement with either one of the prop-outs, if present, to pull the prop-outs above the valve 29. If no special prop-out is used when the wash pipe clears the valve it will automatically move to closed position under the force of spring 41.

At this time other operations may be carried out as desired in completing the well with the gravel pack protecting the annulus and the valve 18 protecting the interior of the screen from fluids thereabove.

The work string is then completely removed from the well and the production string, the lower end of which is shown at 42, is introduced into the well and run into sealing engagement with the upper packer 16, preferably at the lower flow tube 43 of the packer. The seal 44 provides a seal between the packer and the production string.

Figure 4A:
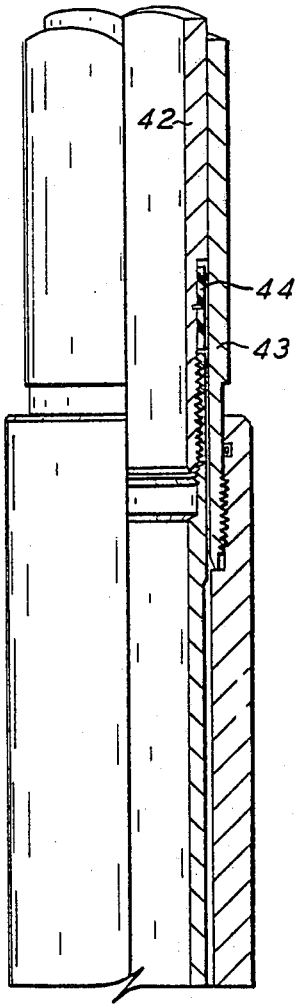
FIGS. 4A, 4B and 4C are continuation views partly in elevation and partly in quarter-section with sections broken away to illustrate details showing the valve in closed position and the production string in place and engaging the mechanical opening sleeve.
Figure 4C:
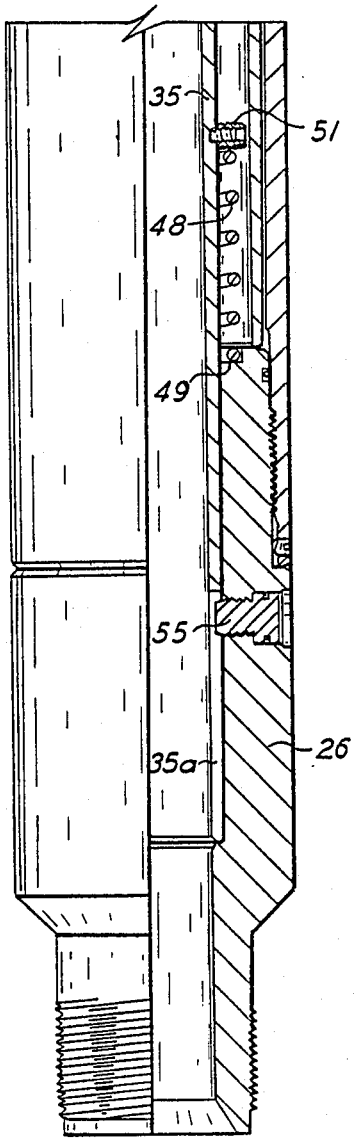
Figure 4B:
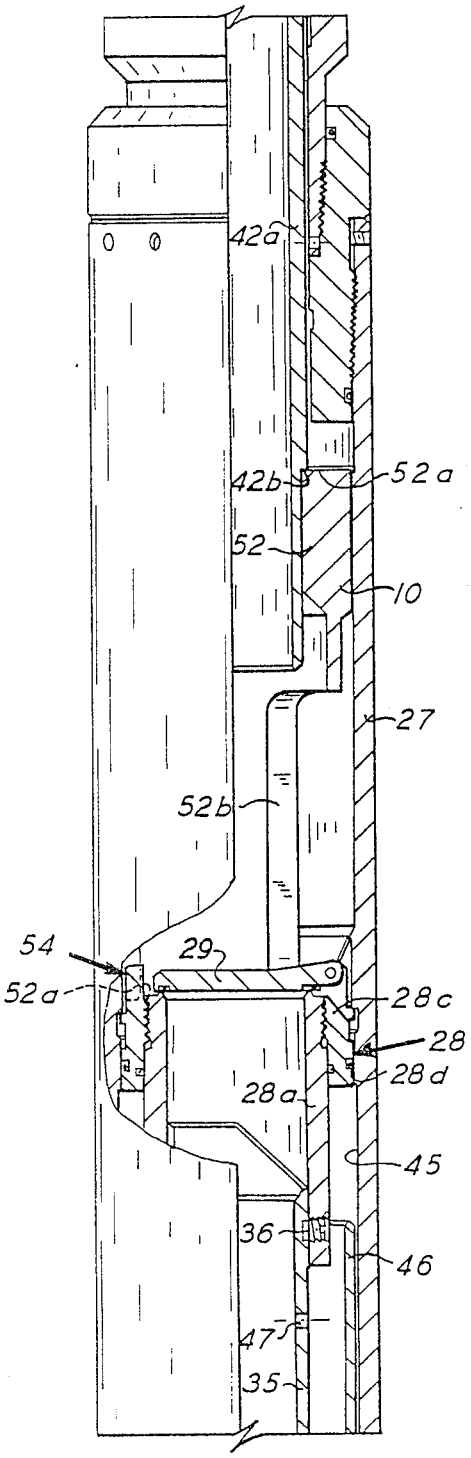

At this time pressure within the production string may be increased to result in shearing of shear pin 36 and driving of the valve seat and its associated valve member 29 downwardly, as shown in FIG. 5, to full open position. At the same time the spring 48 will drive the valve opener 35 to full open position, as shown in FIG. 5, to prop the valve 39 in full open position.

Where a mechanical opening sleeve is used as in FIG. 4B, the sleeve will be moved downwardly by the production string 42 to mechanically force the valve seat 28 downwardly to shear the pin 36 to result in the parts moving into the position shown in FIG. 5. The production string in the position shown in FIG. 5 will also serve to maintain the valve seat in its lower position.

The foregoing disclosure and description of the invention is illustrative and explanatory thereof and various changes in the size, shape and materials and various changes in the method, as well as in the details of the illustrated construction, may be made within the scope of the appended claims without departing from the spirit of the invention.

What is claimed is:

1. A method of protecting a well formation during a gravel pack completion operation comprising, landing in a well a packer with a depending screen and a valve controlling flow through the screen and packer, maintaining said valve open while utilizing a wash pipe to pack gravel about said screen, closing said valve in response to withdrawing said wash pipe from the screen, pulling said wash pipe from the well and running a production string into sealing engagement with said packer, and opening said valve in response to force exerted through said production string.

2. The method of claim 1 wherein said valve is opened in response to pressure within the production string.

3. The method of claim 1 wherein said valve is opened by downward movement of the production string.

4. The method of claim 1 wherein the valve is initially mechanically propped-out and the prop-out releases the valve in response to withdrawal of the wash pipe.

5. The method of claim 4 wherein the wash pipe provides the mechanical prop-out.

6. The method of claim 1 wherein after the valve has been opened the production string maintains said valve in open position.

* * * * *